US010494984B2

(12) United States Patent
Bonkoski et al.

(10) Patent No.: US 10,494,984 B2
(45) Date of Patent: Dec. 3, 2019

(54) METHOD AND SYSTEM FOR MONITORING COOLING SYSTEM

(71) Applicant: Ford Global Technologies, LLC, Dearborn, MI (US)

(72) Inventors: Phillip Bonkoski, Ann Arbor, MI (US); Amey Y. Karnik, Canton, MI (US); Meisam Mehravaran, Royal Oak, MI (US); Joshua Putman Styron, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 443 days.

(21) Appl. No.: 15/267,010

(22) Filed: Sep. 15, 2016

(65) Prior Publication Data

US 2018/0073418 A1 Mar. 15, 2018

(51) Int. Cl.

| | |
|---|---|
| ***F01P 7/16*** | (2006.01) |
| ***F01P 5/10*** | (2006.01) |
| *F01P 7/14* | (2006.01) |

(52) U.S. Cl.

CPC ..... *F01P 7/16* (2013.01); *F01P 5/10* (2013.01); *F01P 2007/146* (2013.01); *F01P 2025/08* (2013.01); *F01P 2031/18* (2013.01)

(58) Field of Classification Search

CPC ..... F01P 7/16; F01P 7/14; F01P 5/10; F01P 11/18; F01P 11/16; F01P 2007/146; F01P 2025/08; F01P 2031/18; G01M 15/00; G01M 15/04; G01M 15/042

See application file for complete search history.

(56) References Cited

U.S. PATENT DOCUMENTS

| | | | | |
|---|---|---|---|---|
| 6,200,021 | B1 * | 3/2001 | Mitsutani | F01P 11/16 374/1 |
| 6,302,065 | B1 | 10/2001 | Davison | |
| 6,763,709 | B1 * | 7/2004 | Haggett | F01P 11/16 73/114.68 |
| 6,957,570 | B2 | 10/2005 | Wakahara et al. | |
| 7,111,506 | B2 * | 9/2006 | Tsukamoto | F01P 11/14 73/114.68 |
| 8,122,858 | B2 * | 2/2012 | Fujimoto | F01P 11/16 123/41.1 |
| 8,689,617 | B2 * | 4/2014 | Rollinger | F01P 7/048 73/114.68 |
| 9,217,689 | B2 * | 12/2015 | Rollinger | F01P 7/048 |
| 2005/0006487 | A1 * | 1/2005 | Suda | F01P 7/167 236/46 R |
| 2014/0023107 | A1 * | 1/2014 | Furuta | G01N 25/72 374/4 |
| 2014/0142819 | A1 * | 5/2014 | Pursifull | F01P 11/16 701/51 |
| 2015/0152775 | A1 * | 6/2015 | Ando | F01P 7/165 165/287 |

* cited by examiner

*Primary Examiner* — Grant Moubry

(74) *Attorney, Agent, or Firm* — Geoffrey Brumbaugh; McCoy Russell LLP

(57) ABSTRACT

Methods and systems are provided for determining coolant system health. In one example, a method may include predicting degradation in the coolant system based on oscillations of an estimated coolant temperature at an outlet of a radiator. The method may further control an engine based on the estimated coolant temperature.

14 Claims, 5 Drawing Sheets

METHOD AND SYSTEM FOR MONITORING COOLING SYSTEM

FIELD

The present description relates generally to methods and systems for monitoring cooling system health based on estimated coolant temperature at a position between an end of a radiator core and a junction of a radiator lower hose and a heater core output line.

BACKGROUND/SUMMARY

In automotive thermal management, coolant temperature in a cooling system is closely controlled for improved engine efficiency and emission. The cooling system may include a radiator as a primary heat exchanger, and a thermostat for controlling coolant flow through the radiator. For example, at one thermostat position, the coolant flow may bypass the radiator so that waste heat may be utilized to warm-up the engine. At another thermostat position, the coolant flow may pass through the radiator for maximum heat rejection. Degradation of the cooling system, such as thermostat degradation, may deteriorate engine fuel consumption and emission.

Other attempts for monitoring cooling system include comparing an estimated engine coolant temperature with a measured engine coolant temperature. One example approach is shown by Davison et al. in U.S. Pat. No. 6,302,065 B1. Therein, engine coolant temperature is estimated via a coolant temperature model. Based on the position of a thermostat, a high coolant temperature model or a low coolant temperature model is used for estimating the engine coolant temperature. Degradation of coolant temperature sensor and the thermostat can then be determined if the difference between the estimated and the measured engine coolant temperatures is larger than a threshold.

However, the inventors herein have recognized potential issues with such methods. As one example, coolant temperature in the cooling system oscillates responsive to the thermostat's position. The oscillation in coolant temperature may cause system degradation. For example, oscillation of coolant temperature in the radiator may cause expanding and contracting of different sections of the radiator, and may lead to radiator failure, such as leaking. Aside from leaking of the coolant, radiator failure may cause engine overheat and severe damage to the vehicle system. Further, when introducing hot engine coolant to the cold bulk coolant in the radiator, stagnated flow pockets are formed due to viscosity differences between hot and cold coolants. Radiator failures due to thermal strain and fatigue are more likely to occur near the areas of high temperature variations caused by either flow stagnation or intermittent flow.

In one example, the issues described above may be addressed by a method comprising: adjusting coolant flow with a thermostat; based on thermostat position, estimating a coolant temperature at a location between an end of a radiator core and a junction of a radiator lower hose and a heater core output line; and indicating cooling system health based on the estimated coolant temperature. In this way, cooling system health may be evaluated before occurrence of system degradation, so that procedures may be taken to prevent future system failure.

As one example, a method may determine radiator failure and thermostat degradation based on an estimated coolant temperature at a radiator outlet. The radiator outlet is defined as an opening on the radiator housing from where a lower hose is coupled to. The coolant temperature may be estimated as a mathematical function of a coolant flow rate at the radiator outlet. The direction of the coolant flow at the radiator outlet depends on thermostat position. The thermostat may be at a first position to stop low temperature coolant from the thermostat to the radiator, and at a second position to allow high temperature coolant from the thermostat to the radiator. A coolant pump in fluid communication with the radiator outlet may pump coolant to an engine block. In the radiator bypass mode, when no coolant flows to the radiator inlet from the thermostat, operating the coolant pump may create a low pressure condition from the pump inlet extending to the radiator outlet. The low pressure condition may draw hot coolant from the heater core to the radiator outlet via a radiator bleed line. Consequently, coolant temperature at the radiator outlet may be affected by the reversed hot coolant flow drawn from the heater core. By incorporating the reversed coolant flow into a model, coolant temperature oscillation in the cooling system may be accurately simulated. The model may further be used to estimate other engine operating parameters such as engine temperature and radiator temperature for improved engine control. By evaluating the estimated oscillation of coolant temperature, radiator failure may be predicated in real-time without requirement of additional hardware. By comparing the estimated coolant temperature to a measured coolant temperature at the radiator outlet, thermostat degradation may also be determined.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1A:
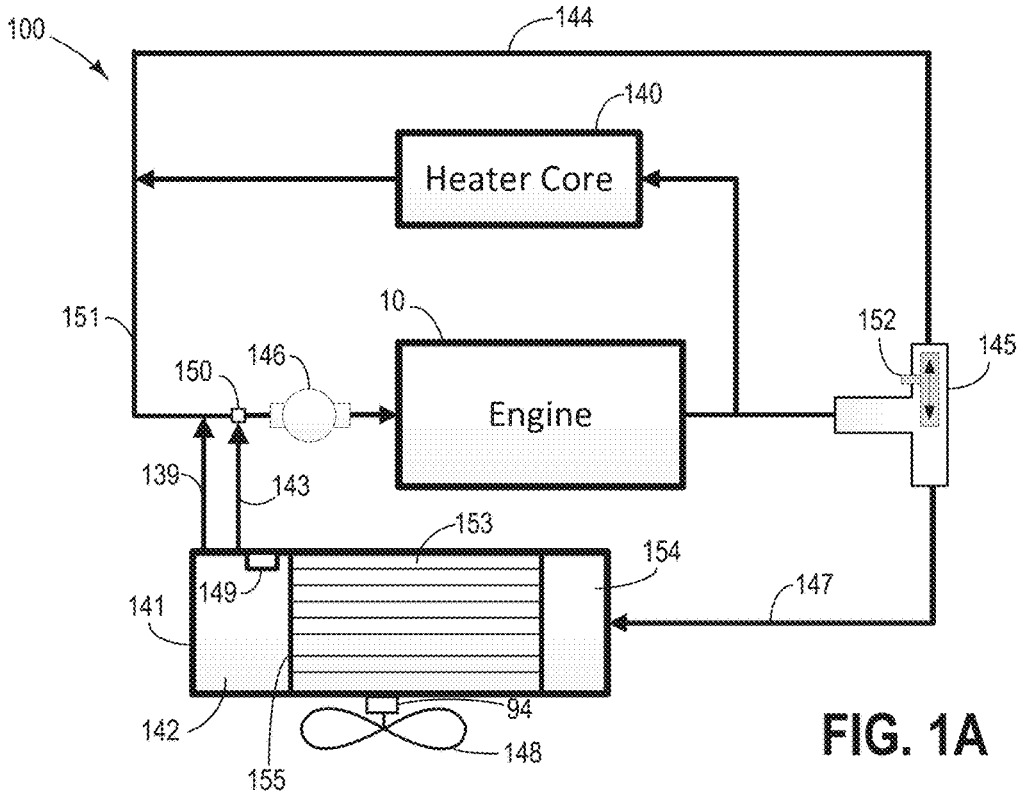
FIG. 1A schematically shows an example embodiment of a cooling system for an engine with a thermostat at a first position.
Figure 1B:
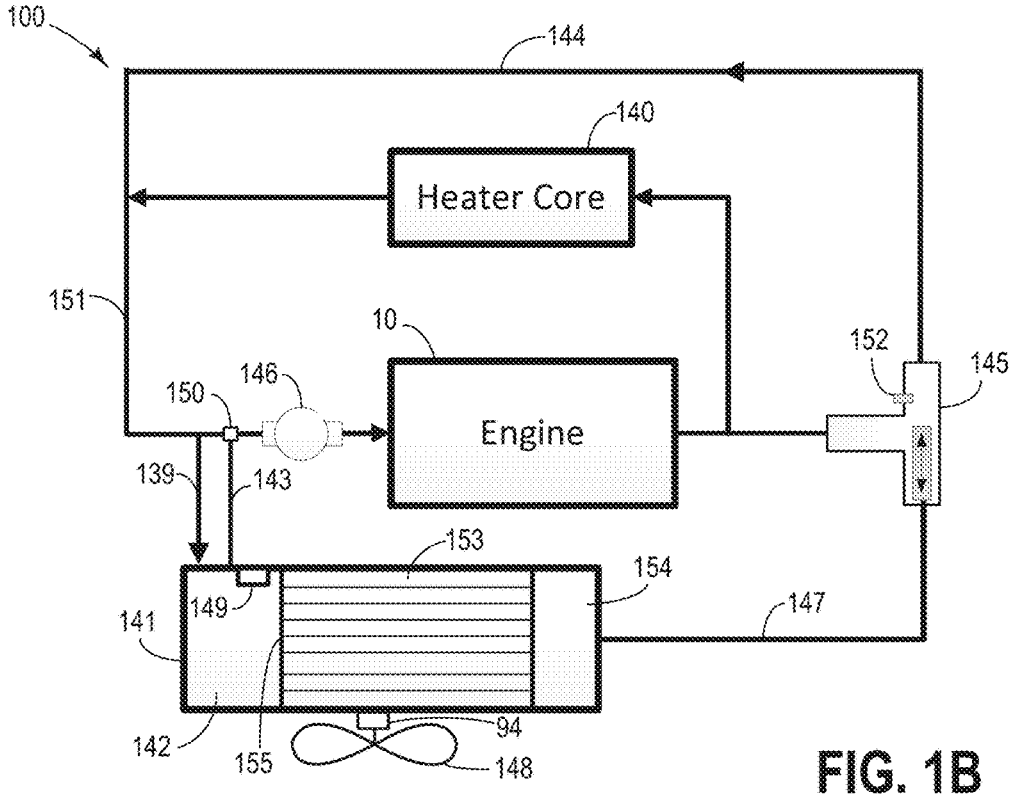
FIG. 1B shows the cooling system with the thermostat at a second position.
Figure 2:
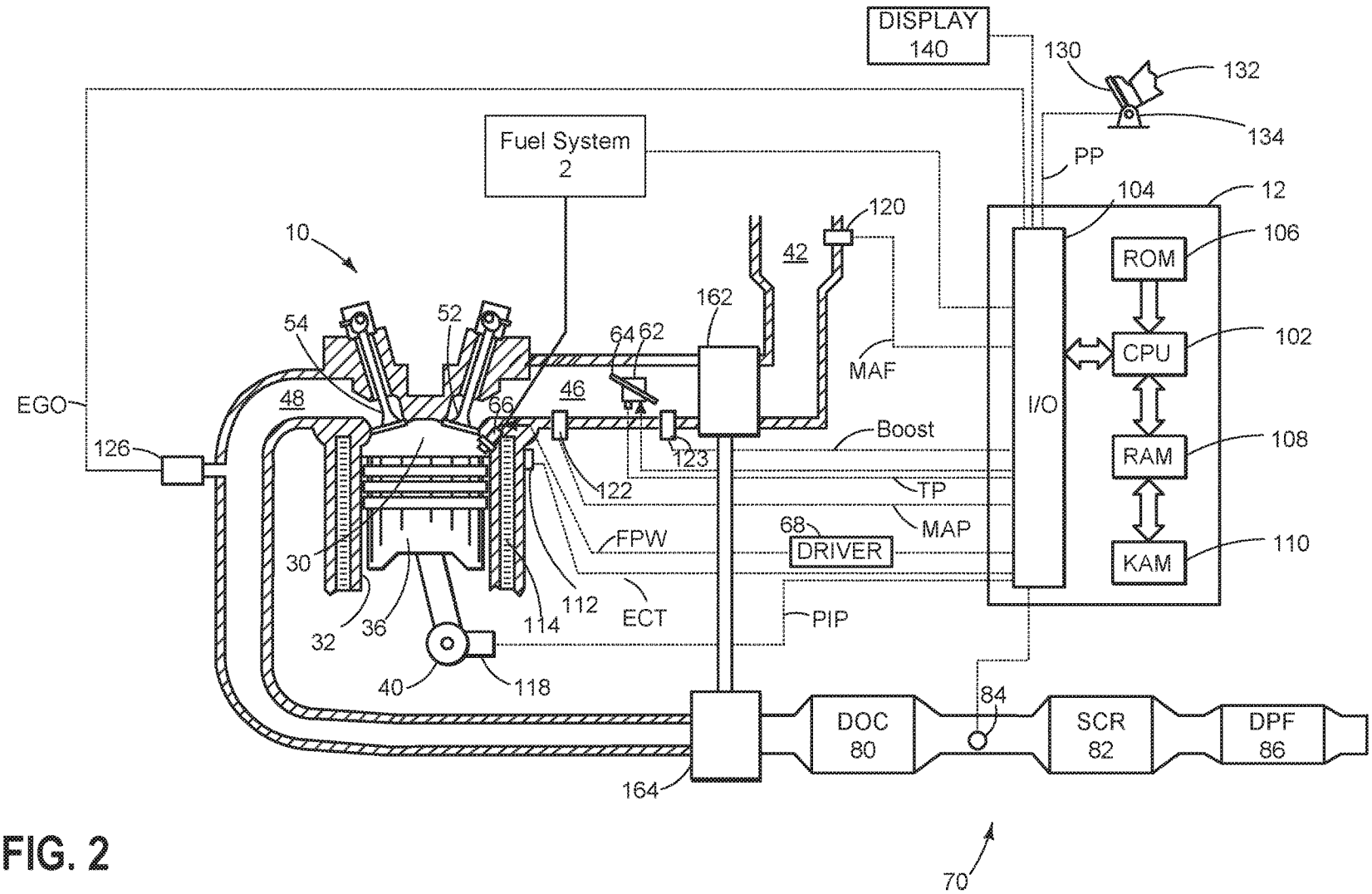
FIG. 2 shows a schematic diagram of an example cylinder of a multi-cylinder engine with an emission control device coupled to an engine exhaust system.
Figure 3:
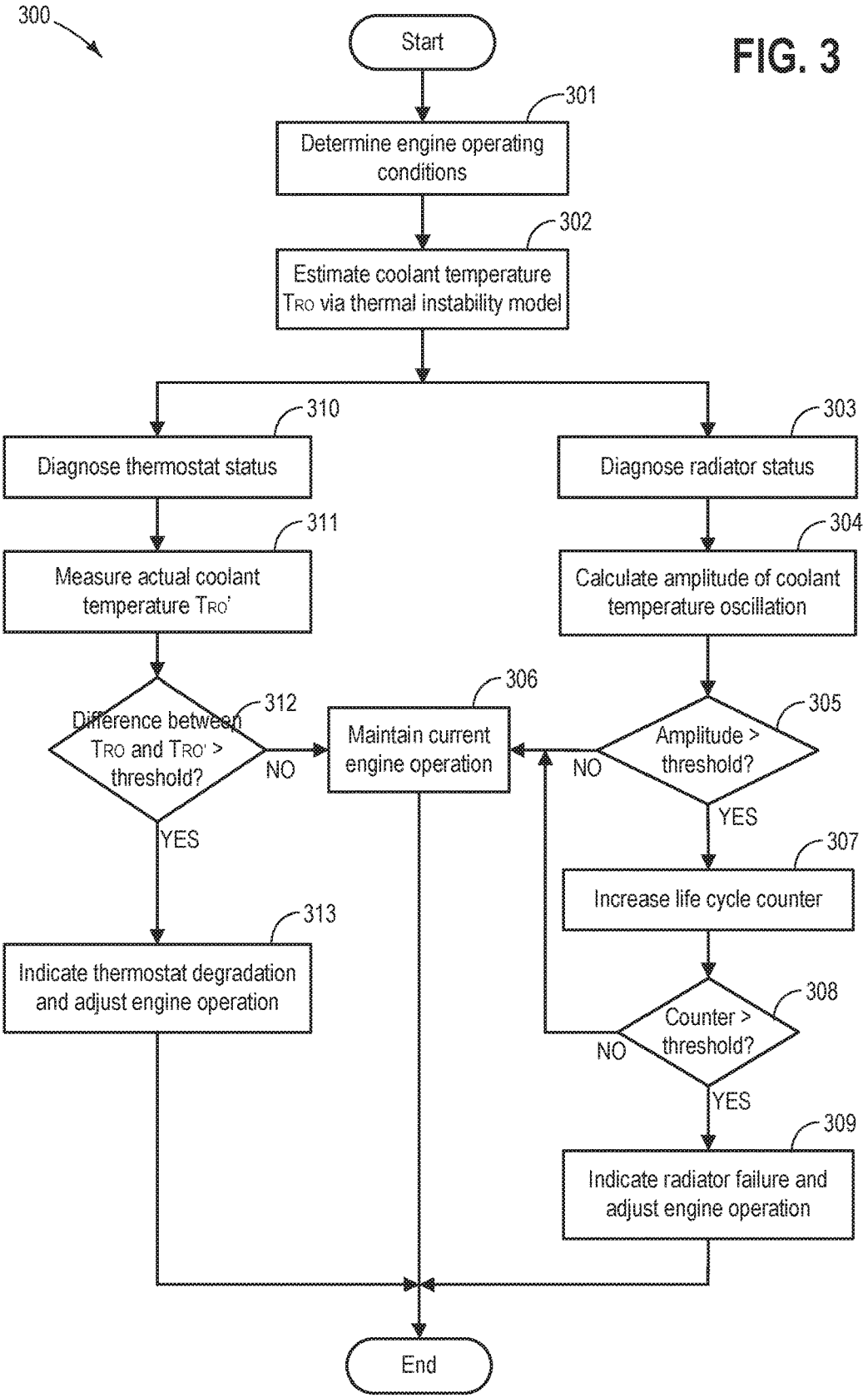
FIG. 3 shows an example method for monitoring a cooling system.
Figure 4:
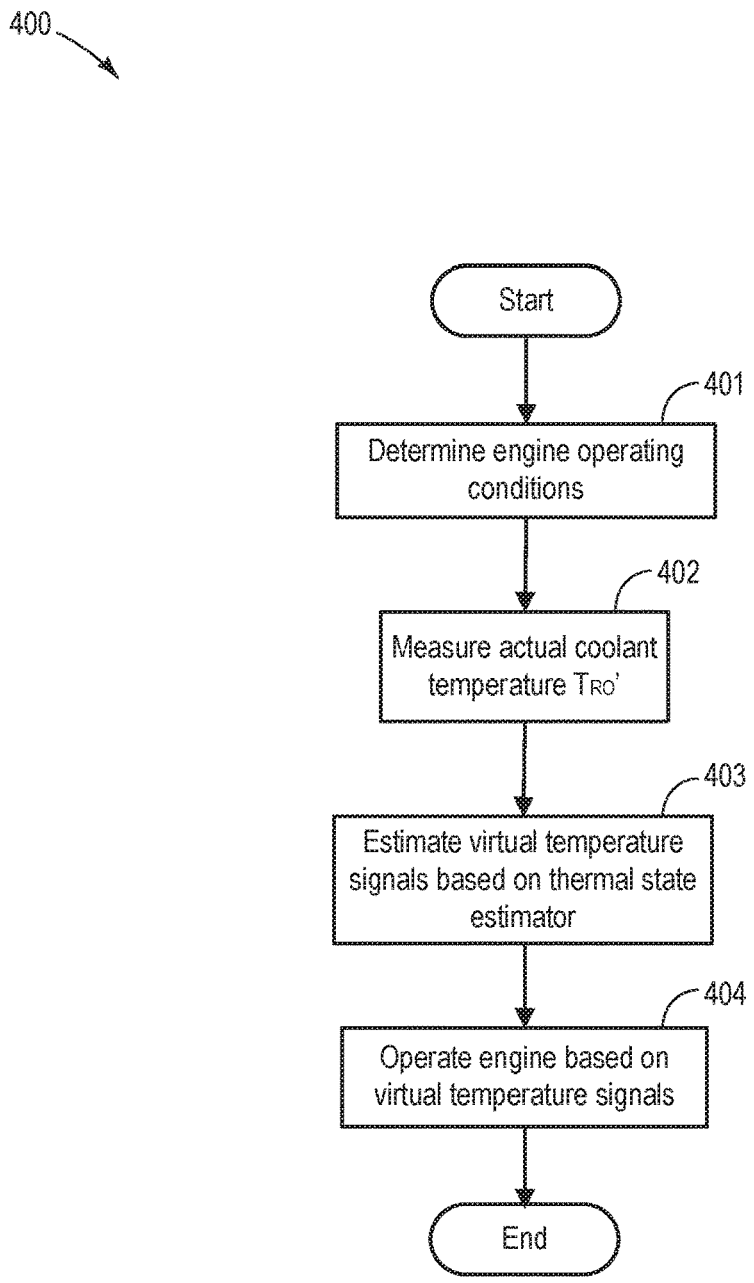
FIG. 4 shows an example method of operating an engine based on a thermal instability prediction model.
Figure 5:
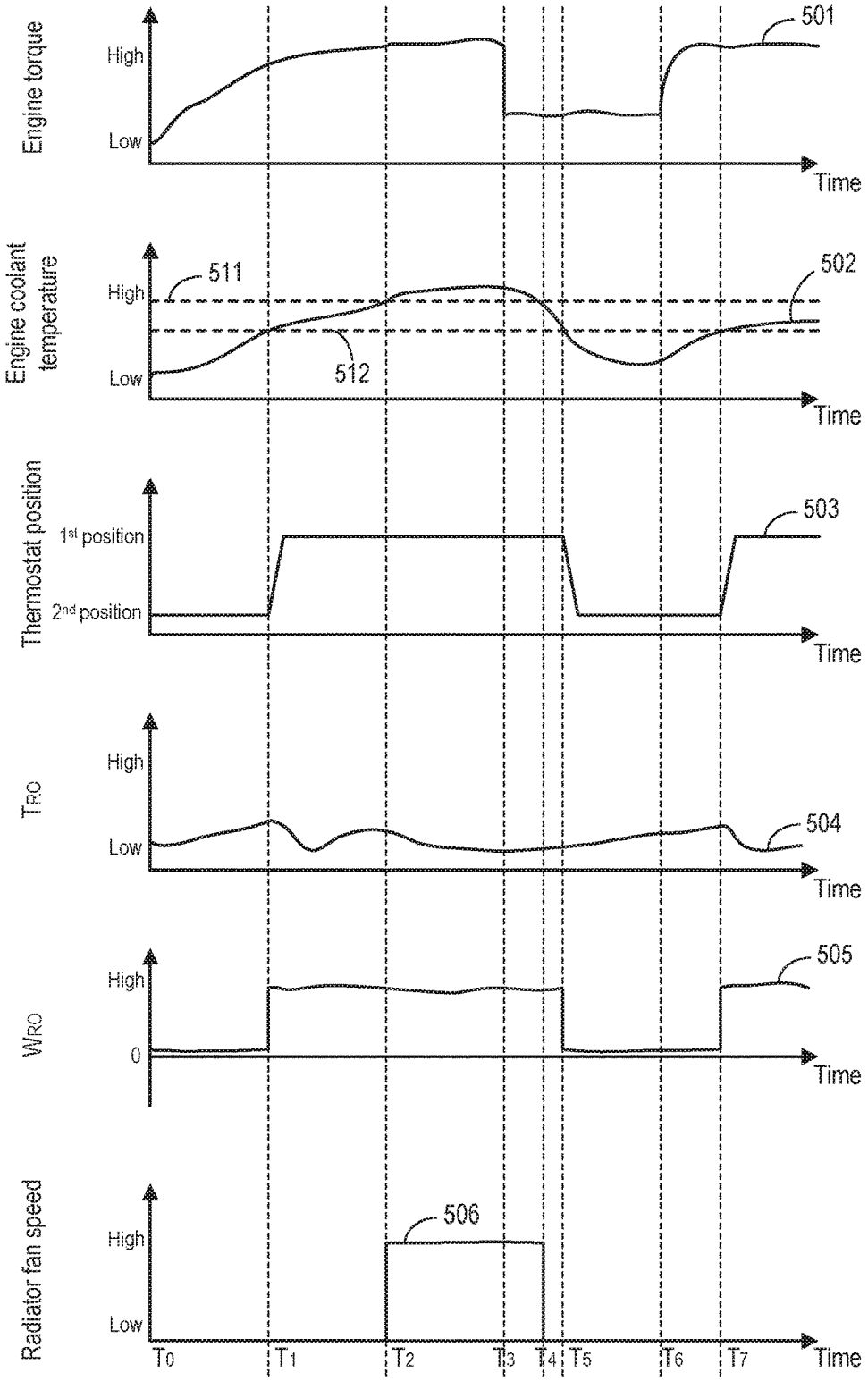
FIG. 5 are timelines illustrating various engine parameters while implementing the example method.

The following description relates to systems and methods for monitoring a cooling system of an internal combustion engine, such as the cooling system shown in FIGS. 1A and 1B. The cooling system includes a thermostat for controlling coolant flow in response to engine coolant temperature. For example, when the engine coolant temperature is high, coolant may flow through the radiator for heat rejection as shown in FIG. 1A. When the engine coolant temperature is low, coolant may bypass the radiator to warm up the engine as shown in FIG. 1B. FIG. 2 shows an example internal combustion engine system coupled to the cooling system. FIG. 3 is a flow chart of an example method for monitoring the cooling system based on a thermal instability prediction model. The model may predict radiator failure and thermostat degradation based on an estimation of coolant temperature at a position between an end of a radiator core and a junction of a radiator lower hose and a heater core output line. FIG. 4 shows that the thermal instability prediction model may be incorporated into a thermal state estimator and generate virtual temperature signals to facilitate engine operation. FIG. 5 illustrates the status of engine operating parameters and actuators while implementing the example method.

Turning to FIG. 1, an example cooling system 100 of a vehicle is demonstrated. The cooling system may be coupled to engine 10 and circulate coolant through the engine. An engine driven coolant pump 146 may be directly coupled upstream of engine 10 for delivering coolant through passages in the engine block, head, etc. to absorb engine heat. The coolant pump 146 may alternatively be an electric pump. Heated coolant from the engine output may be directed to a heater core 140 where the heat may be transferred to passenger compartment. The heated coolant may flow from the thermostat to a radiator 141 via upper hose 147. Radiator 141 may include a front tank 154 directly coupled to upper hose 147, an end tank directly coupled to a lower hose 143, and a radiator core 153 positioned between the front tank and end tank. Fin combs may be arranged within the radiator core for releasing coolant heat to the ambient air. Radiator 141 may be coupled to a radiator fan 148 to provide cooling airflow assistance through radiator. The radiator fan speed may be controlled via actuator 94. Cooled coolant is drawn to the engine via lower hose 143 by operating pump 146. Bleed hose 139 may couple between radiator end tank 142 and coolant pump 146 for bleeding excess air from the radiator. In one embodiment, a coolant reservoir (not shown) may be positioned upstream of the pump inlet, and the bleed flow of excess air from the radiator may first be directed through the coolant reservoir before being supplied to pump 146.

A temperature sensor 149 may be used for monitoring coolant temperature. In one embodiment, temperature sensor 149 may be positioned within end tank 142. In another embodiment, temperature sensor 149 may be coupled to lower hose 143. In another embodiment, temperature sensor 149 may be positioned at the radiator outlet. The radiator outlet is an opening in the radiator housing that is directly coupled to lower hose 143. In yet another embodiment, there may be no temperature sensor coupled to the lower hose or the radiator outlet. Instead, the temperature sensor may be positioned in another location of the engine system, such as coupled to an engine block or cylinder head. In this embodiment, a temperature sensor may be included at least at one location of the engine system. For example, the temperature sensor may be coupled to the engine block or cylinder head.

A thermostat 145 may be arranged in direct fluid communication downstream of engine 10. In one embodiment, thermostat 145 may be a wax type thermostat. Responsive to coolant temperature, thermostat position may continuously adjust between a first position with coolant flowing through the radiator and a second position with coolant bypassing the radiator. Thermostat position may be measured with sensor 152.

When thermostat 145 is at a first position as shown in FIG. 1A, part of coolant exiting engine 10 is directed to heater core 140. The rest of coolant exiting engine 10 is directed to radiator inlet via upper hose 147. There is no coolant flow in passage 144. Coolant exits radiator end tank 142 via radiator outlet and joins with coolant from heater core 140 at junction 150 between lower hose 143 and heater core outlet line 151. The mixed coolant is then pumped through engine 10 via pump 146. Excess air and some coolant may flow from the radiator end tank to coolant pump through bleed hose 139.

When thermostat 145 is at a second position as shown in FIG. 1B, coolant flow to radiator 141 is blocked. In other words, coolant flow in upper hose 147 is zero. Coolant exiting engine 10 first flows through heater core 140 and passage 144, then rejoined at a location upstream of the inlet of pump 146. While pumping coolant into engine 10 via pump 146, a low pressure condition may present at the pump inlet side and propagate back to lower hose 143 and radiator end tank 142. As such, a pressure difference may present between the outlet of heater core 140 and the radiator outlet (or radiator end tank). The pressure difference may draw coolant exiting the heater core to the radiator end tank via heater core outlet line 151 and bleed hose 139. This coolant flow may displace coolant from end tank 142, forcing a small flow out of the lower hose 143. Temperature of the coolant entering end tank 142 from heater core 140 may be higher than the coolant temperature in end tank 142. Therefore, coolant temperature at radiator outlet may increase due to the reversed coolant flow in bleed hose 139 when the radiator is bypassed.

FIGS. 1A-1B show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As another example, elements positioned apart from each other with only a space there-between and no other components may be referred to as such, in at least one example.

Turning now to FIG. 2, a schematic diagram showing one cylinder of multi-cylinder engine 10, which may be included in a propulsion system of an automobile, is shown. Engine 10 may be controlled at least partially by a control system including controller 12 and by input from a vehicle operator 132 via an input device 130. In this example, input device 130 includes an accelerator pedal and a pedal position sensor 134 for generating a proportional pedal position signal PP. Combustion chamber (i.e., cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of a vehicle via an intermediate transmission system. Further, a starter motor may be coupled to crankshaft 40 via a flywheel to enable a starting operation of engine 10.

Combustion chamber 30 may receive intake air from intake manifold 46 via intake passage 42 and may exhaust combustion gases via exhaust passage 48. Intake manifold 46 and exhaust passage 48 can selectively communicate with combustion chamber 30 via respective intake valve 52 and exhaust valve 54. In some embodiments, combustion chamber 30 may include two or more intake valves and/or two or more exhaust valves.

Fuel injector 66 is shown coupled directly to combustion chamber 30 for injecting fuel directly therein in proportion to the pulse width of signal FPW received from controller 12 via electronic driver 68. In this manner, fuel injector 66 provides what is known as direct injection of fuel into combustion chamber 30. The fuel injector may be mounted in the side of the combustion chamber or in the top of the combustion chamber, for example. Fuel may be delivered to fuel injector 66 by fuel system 2.

The injection timing of fuel from the fuel injector (or injectors) may be adjusted, depending on engine operating conditions. For example, fuel injection timing may be retarded or advanced from controller pre-set values in order to maintain desired engine torque and performance.

Intake manifold 46 may include a throttle 62, having a throttle plate 64. The position of throttle plate 64 may be varied by controller 12 via a signal provided to an electric motor or actuator included with throttle 62, a configuration that is commonly referred to as electronic throttle control (ETC). In this manner, throttle 62 may be operated to vary the intake air provided to combustion chamber 30 among other engine cylinders. The position of throttle plate 64 may be provided to controller 12 by throttle position signal TP. Intake passage 42 may include a mass air flow sensor 120 and a manifold air pressure sensor 122 for providing respective signals MAF and MAP to controller 12.

Combustion chamber 30 or one or more other combustion chambers of engine 10 may be operated in a compression ignition mode, without an ignition spark. Further, engine 10 may be turbocharged by a compressor 162 disposed along the intake manifold 46 and a turbine 164 disposed along the exhaust passage 48 upstream of the exhaust after-treatment system 70. Though FIG. 2 shows only one cylinder of a multi-cylinder engine, each cylinder may similarly include its own set of intake/exhaust valves, fuel injector, etc.

Exhaust gas sensor 126 is shown coupled to exhaust passage 48 upstream of an exhaust gas after-treatment system 70. Sensor 126 may be any suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor.

The exhaust gas after-treatment system 70 may include a plurality of emission control devices, each of which may carry out an exothermic reaction with excess oxygen present in the exhaust during selected conditions (e.g., selected temperatures). For example, the exhaust gas after-treatment system 70 may include a diesel oxidation catalyst (DOC) 80 disposed along exhaust passage 48 downstream of turbine 164. The diesel oxidation catalyst may be configured to oxidize HC and CO in the exhaust gas. A selective catalytic reduction catalyst (SCR) catalyst 82 may be disposed along the exhaust gas conduit downstream of DOC 80. The SCR catalyst may be configured to reduce NOx in the exhaust gas to nitrogen and water. A urea sprayer 84 (or any suitable SCR reductant source, such as an ammonia source) may be disposed upstream of SCR catalyst 82 and downstream of DOC 80. A diesel particulate filter (DPF) 86 may be disposed along the exhaust conduit downstream of SCR catalyst 82. The DPF may be configured to remove diesel particulate matter (or soot) from the exhaust gas.

Controller 12 is shown in FIG. 2 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; boost pressure (Boost) from boost pressure sensor 123; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Additionally, controller 12 may communicate with a cluster display device 140, for example to alert the driver of faults in the engine or exhaust after-treatment system.

Furthermore, controller 12 may communicate with various actuators, which may include engine actuators such as fuel injectors, an electronically controlled intake air throttle plate, camshafts, etc. In some examples, storage medium read only memory chip 106 may be programmed with computer readable data representing instructions executable by microprocessor unit 102 for performing the methods described below as well as other variants that are anticipated but not specifically listed.

Based on the received signals from the various sensors of FIGS. 1 and 2 and instruction stored on the memory of the controller, controller 12 may employ various actuators of FIGS. 1 and 2 to adjust engine operation. As an example, adjusting coolant temperature may include adjusting actuator 94 of radiator fan 148 to adjust cooling air flow through the radiator.

FIG. 3 demonstrates an example method 300 for monitoring cooling system health. The method estimates coolant temperature at a position between an end of a radiator core (such as 155 in FIG. 1) and a junction between a radiator lower hose and a heater core output line (such as junction 150 in FIG. 1) based on a thermal instability prediction model. Within the model, coolant flow rate in the radiator lower hose (such as lower hose 143 in FIG. 1) may be determined responsive to a thermostat position. When the thermostat is at a first position with the coolant flowing through the radiator (as shown in FIG. 1A), coolant flow rate in the radiator lower hose may be a function of coolant flow rate through the engine and the coolant flow rate through a heat core. When the thermostat is at a second position with the coolant bypassing the radiator (as shown in FIG. 1B), the coolant flow rate in the radiator lower hose may be a function of coolant flow rate through the engine. In other words, in the radiator bypassing mode, even though no coolant flows from the engine to the radiator, coolant flow rate in the bleed hose may be nonzero due to lower pressure presented at the radiator outlet comparing to the heater core outlet. By calculating the amplitude and/or number of cycles of the coolant temperature oscillation at radiator outlet, radiator failure may be predicated. By comparing the estimated coolant temperature with a measured coolant temperature, thermostat or radiator degradation may be determined.

Instructions for carrying out method 300 and the rest of the methods included herein may be executed by a controller (such as controller 12 in FIG. 2) based on instructions stored on a memory of the controller and in conjunction with signals received from sensors of the engine system, such as the sensors described above with reference to FIGS. 1 and 2. The controller may employ engine actuators of the engine system to adjust engine operation, according to the methods described below.

At step 301, vehicle operating conditions are estimated by the controller. The controller acquires measurements from various sensors in the engine system and estimates operating conditions including engine load, vehicle speed, engine speed, engine coolant temperature, thermostat position, vehicle cabin temperature, and ambient temperature.

At step 302, method 300 estimates coolant temperature $T_{RO}$ at a position between an end of a radiator core and a junction between a radiator lower hose and a heater core output line. As an example, the controller may estimate coolant temperature $T_{RO}$ at a radiator outlet, wherein the radiator outlet is an opening in the radiator housing and is directly coupled to a lower hose. As another example, the controller may estimate coolant temperature $T_{RO}$ in the radiator end tank. As yet another example, the controller may estimate coolant temperature $T_{RO}$ in the radiator lower hose. As a non-limiting example, the coolant temperature $T_{RO}$ is hereafter referred to as coolant temperature at radiator outlet.

The coolant temperature $T_{RO}$ is estimated via a thermal instability model, wherein coolant flow is modeled based on thermostat position. In other words, the estimated coolant temperature is a mathematical function of the thermostat position. The thermal instability model may predict delays affecting thermostat positions and the oscillations in the coolant temperature, such as coolant temperature oscillations at radiator outlet. For example, inputs to the thermal instability model may include vehicle speed, engine speed, vehicles cabin temperature, and ambient temperature that are measured or estimated at step 302. Outputs of the thermal instability model may include estimations of radiator outlet temperature, engine temperature, and radiator temperature. Thermostat position may also be estimated instead of being measured, based on the inputs listed above. The thermal instability model may be constructed based on equations 1-16:

$$C_{eng}\frac{dT_{eng}}{dt} = Q_{comb} - k_{eng}(T_{eng} - T_{amb}) + w_{eng}c_{cool}(T_{eng,in} - T_{eng}) \quad \text{Equation 1}$$

$$C_{rad}\frac{dT_{rad}}{dt} = -k_{rad}(T_{rad} - T_{amb}) + w_{rad}c_{cool}(T_{eng} - T_{rad}) \quad \text{Equation 2}$$

$$C_{RO}\frac{dT_{RO}}{dt} = w_{rad}c_{cool}(T_{rad} - T_{RO}) + w_{mix}c_{cool}(T_{eng,in} - T_{RO}) \quad \text{Equation 3}$$

$$C_{HC}\frac{dT_{HC}}{dt} = -k_{HC}(T_{HC} - T_{cab}) + w_{HC}c_{cool}(T_{eng} - T_{HC}) \quad \text{Equation 4}$$

$$w_{eng} = a_{eng,w1}N + a_{eng,w2}Nu_{Tstat} \quad \text{Equation 5}$$

$$w_{HC} = a_{HC,w1}N \quad \text{Equation 6}$$

$$w_{RAD} = (w_{eng} - w_{HC})u_{Tstat} \quad \text{Equation 7}$$

$$w_{BP} = (w_{eng} - w_{HC})(1 - u_{Tstat}) \quad \text{Equation 8}$$

$$w_{mix} = a_{mix,w1}w_{eng}(1 - u_{Tstat}) \quad \text{Equation 9}$$

$$w_{RO} = w_{RAD} + w_{mix} \quad \text{Equation 10}$$

$$w_{air} = a_{air,w1}v_{veh} \quad \text{Equation 11}$$

$$k_{eng} = a_{eng,k1}w_{HC}^2 + a_{HC,k2}w_{HC} \quad \text{Equation 12}$$

$$k_{HC} = a_{HC,k1}w_{HC}^2 + a_{HC,k2}w_{HC} \quad \text{Equation 13}$$

$$k_{rad} = a_{rad,k1}w_{air}^2 + a_{rad,k2}w_{air} \quad \text{Equation 14}$$

$$u_{Tstat}[t] = T_{eng}[t - T_{D,2}]K_{tstat(lift\ gain)} \quad \text{Equation 15}$$

$$T_{eng,in} = \frac{w_{BP}T_{eng} + w_{HC}T_{HC} + w_{RO}T_{RO}}{w_{BP} + w_{HC} + w_{RO}} \quad \text{Equation 16}$$

Definition, source, and range/unit of the variables in Equations 1-16 are shown in TABLE 1.

TABLE 1

| Variable | Description | Source | Range/Units |
|---|---|---|---|
| $C_{eng}$ | Engine thermal mass | Calibration constant | 1000-500000 J/K |
| $C_{rad}$ | Radiator thermal mass | Calibration constant | 1000-500000 J/K |
| $C_{RO}$ | Radiator outlet thermal mass | Calibration constant | 100-100000 J/K |
| $C_{HC}$ | Heater core thermal mass | Calibration constant | 100-100000 J/K |
| $T_{eng}$ | Engine temperature | Internal variable | deg C. |
| $T_{rad}$ | Radiator temperature | Internal variable | deg C. |
| $T_{RO}$ | Radiator outlet temperature | Internal variable | deg C. |
| $T_{HC}$ | Heater core temperature | Internal variable | deg C. |
| $T_{amb}$ | Ambient temperature | External input | deg C. |
| $T_{cab}$ | Vehicle cabin temperature | External input | deg C. |
| $T_{eng,in}$ | Engine inlet temperature | Internal variable | deg C. |
| $c_{cool}$ | Coolant specific heat | Calibration constant | 2000-4000 J/kg-K |
| $w_{eng}$ | Engine coolant flow rate | Internal variable | kg/s |
| $w_{HC}$ | Heater core coolant flow rate | Internal variable | kg/s |
| $w_{RAD}$ | Radiator coolant flow rate | Internal variable | kg/s |
| $w_{BP}$ | Bypass coolant flow rate | Internal variable | kg/s |
| $w_{mix}$ | Bleed hose coolant flow rate | Internal variable | kg/s |
| $w_{RO}$ | Radiator outlet coolant flow rate | Internal variable | kg/s |
| $w_{air}$ | Radiator air flow rate | Internal variable | kg/s |
| $v_{veh}$ | Vehicle speed | External input | mph |
| N | Engine speed | External input | rpm |
| $u_{Tstat}$ | Thermostat position | Internal variable | (unitless) (normalized) |
| $a_{eng,w1}$ | Engine flow constant | Calibration constant | 0.0001-0.01 kg/s-rpm |
| $a_{eng,w2}$ | Engine flow constant | Calibration constant | 0-0.01 kg/s-rpm |
| $a_{HC,w1}$ | Heater core flow constant | Calibration constant | 0-0.001 kg/s-rpm |
| $a_{mix,w1}$ | Bleed hose flow constant | Calibration constant | 0.001-0.05 (unitless) |
| $a_{air,w1}$ | Radiator air flow constant | Calibration constant | 0.005-0.3 kg/s-mph |
| $k_{eng}$ | Engine heat transfer coefficient | Internal variable | W/K |
| $k_{HC}$ | Heater core heat transfer coefficient | Internal variable | W/K |
| $k_{rad}$ | Radiator heat transfer coefficient | Internal variable | W/K |
| $a_{eng,k1}$ | Engine heat transfer constant | Calibration constant | 0-1000 J/kg-K |
| $a_{eng,k2}$ | Engine hear transfer constant | Calibration constant | 0-5000 W/K |
| $a_{HC,k1}$ | Heater core heat transfer constant | Calibration constant | −5000-0 W-s$^2$/kg$^2$-K |

TABLE 1-continued

| Variable | Description | Source | Range/Units |
|---|---|---|---|
| $a_{HC,k2}$ | Heater core heat transfer constant | Calibration constant | 500-1000 J/kg-K |
| $a_{rad,k1}$ | Radiator heat transfer constant | Calibration constant | −1000-0 W-s$^2$/kg$^2$-K |
| $a_{rad,k2}$ | Radiator heat transfer constant | Calibration constant | 500-1000 J/kg-K |
| t | Time | Internal variable | sec |
| $T_{D,2}$ | Thermostat delay | Calibration constant | 0-20 sec |
| $K_{tstat\ (lift\ gain)}$ | Thermostat lift curve | Calibration table (function of temperature) | 0-1 (unitless) (normalized) |

Equations 5-14 are approximations and may be implemented via lookup tables. When the thermostat is at the first position (as shown in FIG. 1A), coolant flows through the radiator, and $u_{Tstat}$=1. Bleed flow via bleed hose is in the direction exiting the radiator. Since the bleed flow is small, it may be neglected (zero). Coolant flow in passage 144 is zero. When the thermostat is at the second position (as shown in FIG. 1B), coolant bypasses the radiator, and $u_{Tstat}$=0. Radiator flow is zero while the bleed hose coolant flow is non-zero. When coolant flow to the radiator is stopped, operation of coolant pump creates a pressure difference between the input of the coolant pump and the outlet of the heater core. As a result, bleed flow is reversed and flowing into the radiator outlet, causing a warming effect.

Based on the estimated coolant temperature at radiator outlet $T_{OR}$, the controller may determine whether to diagnose the status of the radiator at step 303 and/or diagnose the status of the thermostat at step 310. The status of the thermostat may be diagnosed only if a temperature sensor is available to measure the coolant temperature at radiator outlet. Further, the process for diagnosing radiator and the thermostat (step 303 and 310) may be run in parallel.

If it is determined to diagnose the status of the radiator, at step 304, the controller calculates amplitude of the changes in the estimated coolant temperature from step 302. For example, an average of the estimated coolant temperature may be determined. The average may be calculated by taking running average of the coolant temperature. Alternatively, the average may be calculated by filtering the coolant temperature with a low-pass filter. Amplitude of the oscillation in the estimated coolant temperature may then be determined by computing the maximum difference between instantaneous coolant temperature estimation and the calculated average.

At step 305, the amplitude of coolant temperature oscillation is compared with a predetermined threshold. If the amplitude is greater than a threshold, method 300 moves on to step 307. Otherwise, if the amplitude is not greater than the threshold, method 300 moves on to step 306, where the engine maintains current engine operation.

At step 307, the controller increases a life cycle counter. The life cycle counter may be stored in the memory of the controller. If the counter is greater than a predetermined threshold at step 308, the controller indicates possible radiator failure to a vehicle operator at step 309. For example, the controller may turn on a light on a vehicle display panel. The controller may further adjust engine operation in response to the possible radiator failure. For example, the controller may reduce the upper limit of engine speed or engine load to prevent engine overheat.

At step 310, the controller may determine to diagnose the status of the thermostat if a temperature sensor is available for measuring coolant temperature at a position between an end of a radiator core and a junction between a radiator lower hose and a heater core output line. As an example, the temperature sensor may locate at a radiator outlet, wherein the radiator outlet is an opening in the radiator housing and is directly coupled to a lower hose. As another example, the temperature sensor may be coupled to radiator end tank. As yet another example, temperature sensor may be coupled to the radiator lower hose.

At step 311, the controller may read the actual coolant temperature at radiator outlet $T_{RO}'$ from the temperature sensor.

At step 312, the estimated coolant temperature from step 302 is compared with the measured coolant temperature from step 311. As an example, maximum magnitude of oscillation for each of the estimated and measured coolant temperature is compared. Note that since the phase of the estimated and measured oscillations may not always agree, the estimated and measured coolant temperatures cannot be directly subtracted one from the other. However, the rough magnitudes of oscillations should match. If the difference between the estimated and measured coolant temperatures are within a predetermined threshold, method 300 moves to step 306, wherein the engine maintains current operation. Otherwise, if the difference is larger than the threshold, method 300 may indicate thermostat degradation to the vehicle operator at step 313. Method 300 may also indicate radiator heat transfer degradation from flow obstructions on either the air or coolant side of the radiator. As an example, an indicator on the vehicle display panel may light up. At step 313, the controller may further adjust engine operation in response to thermostat degradation. For example, the controller may increase the speed of the radiator fan to reduce the coolant temperature. As another example, the controller may limit the engine speed and/or engine load to prevent engine overheating.

FIG. 4 shows an example method 400 for operating the engine based on the thermal instability prediction model, such as the model described in step 302 of FIG. 3.

At step 401, similar to step 301 in FIG. 3, vehicle operating conditions are estimated by a controller (e.g. controller 12 in FIG. 2). The controller acquires measurements from various sensors in the engine system and estimates operating conditions such as engine load, vehicle speed, engine speed, engine coolant temperature, thermostat position, vehicle cabin temperature, and ambient temperature.

At step 402, actual coolant temperature at a radiator outlet $T_{RO}'$ is measured by a temperature sensor. As an example, the temperature sensor may be located at a radiator outlet, wherein the radiator outlet is an opening in the radiator housing and is directly coupled to a lower hose. As another example, the temperature sensor may be coupled to the radiator end tank. As yet another example, temperature sensor may be coupled to the radiator lower hose.

At step 403, virtual temperature signals are calculated based on a thermal state estimator. As an example, the thermal state estimator may be a Kalman filter. Inputs to the thermal state estimator may include the measured coolant temperature at the radiator outlet from step 402. The thermal state estimator may be constructed based on a thermal instability prediction model, such as the thermal instability prediction model presented in step 302 of FIG. 3. The virtual temperature signals may include engine temperature and radiator temperature. When the thermostat is in a second position (coolant bypassing the radiator), readings from the temperature sensor tend to converge to the engine temperature. When the thermostat is in a first position (coolant flowing through the radiator), readings from the temperature sensor converge to the radiator temperature. Therefore, both engine temperature and radiator temperature may be inferred based on the measured coolant temperature at radiator outlet. As an example, the measured coolant temperature at the radiator outlet may replace $T_{RO}$ in the thermal instability model presented in Equations 1-16, and engine temperature $T_{eng}$ may be solved as a virtual engine temperature. Alternatively, as another example, radiator temperature $T_{rad}$ may be considered as an unknown and solved through Equations 1-16 as a virtual radiator temperature.

At step 404, method 400 operates the engine based on the estimated virtual temperature signals. For example, radiator fan for the radiator, coolant pump, and valves may be controlled based on the estimated virtual signals.

FIG. 5 illustrates engine operating parameters (i.e. engine torque 501, engine coolant temperature 502, thermostat position 503, coolant temperature at radiator outlet 504, coolant flow rate at radiator outlet 505, and radiator fan speed 506) while monitoring cooling system health with method described in FIGS. 3-4. The x-axes indicate time, and are increased from left to right.

From $T_0$ to $T_1$, with increased engine torque 501, engine coolant temperature 502 increases. The thermostat is at a second position, with coolant bypassing the radiator to reduce engine warm-up time (As shown in FIG. 1B). At radiator outlet, due to the low pressure condition created by the coolant pump, coolant may flow from the heater core outlet to the radiator outlet via the bleed hose. Coolant temperature at radiator outlet may increase. Flow rate at the radiator outlet is low.

At $T_1$, in response to engine coolant temperature 502 higher than a threshold 512, thermostat moves to the first position, where coolant flowing through the radiator. The coolant flowing through the radiator allows the cooled coolant from inside the radiator to flow out and flush out the warmed coolant in the radiator outlet. Consequently, coolant temperature at the radiator outlet 504 may first drop, then increase as warm coolant reaches radiator outlet. Coolant flow rate at radiator outlet increases as coolant flowing from the radiator outlet to the input of the coolant pump (as shown in FIG. 1A).

If engine coolant temperature 502 keeps rising to a threshold 511, the controller may turn on radiator fan 506 at $T_2$. Alternatively, the controller may increase the speed of radiator fan 506 at $T_2$. The speed of the radiator fan may increase in response to increased engine speed. Alternatively, the speed of the radiator fan may increase with increased engine coolant temperature.

In response to a decrease of engine torque at $T_3$, engine coolant temperature decreases. When engine coolant temperature is below threshold 511 at $T_4$, the controller may decrease radiator fan speed. Alternatively, the controller may turn off the radiator fan at $T_4$. When engine coolant temperature further drops below threshold 512 at $T_5$, thermostat moves to the second position. Consequently, coolant temperature at radiator outlet $T_{RO}$ may increase due to the reversed bleed flow in the bleed hose.

At $T_6$, engine torque and engine coolant temperature starts to increase. At $T_7$, thermostat moves to the first position in response to engine coolant temperature higher than threshold 512. Coolant flows through the radiator. Consequently, $T_{RO}$ drops, and $w_{RO}$ increases.

In this way, radiator failure may be predicated based on a thermal instability model without requirement for additional hardware. Further, by measuring the actual coolant temperature at a position between an end of a radiator core and a junction of a radiator lower hose and a heater core output line, thermostat or radiator heat transfer degradation may be identified. Further still, by incorporating the thermal instability model into a thermal state estimator, temperatures of engine components may be estimated and utilized for engine control.

The technical effect of estimating coolant temperature at a position between an end of a radiator core and a junction of a radiator lower hose and a heater core output line is that oscillation in coolant temperature may be better predicated. The technical effect of estimating coolant flow rate at the radiator outlet when coolant is bypassing the radiator is that a reversed coolant flow from the heater core outlet to the radiator outlet may be incorporated into the thermal instability model. The technical effect of constructing a module based on (e.g. as a mathematical function of) the coolant temperature at the radiator outlet is that radiator failure may be predicated by estimating the oscillations of the coolant temperature. The technical effect of comparing the measured coolant temperature with the estimated coolant temperature at the radiator outlet is that thermostat degradation may be determined.

As one embodiment, a method for a cooling system, comprising: adjusting coolant flow with a thermostat, estimating a coolant temperature at a position between an end of a radiator core and a junction of a radiator lower hose and a heater core output line; and indicating cooling system health based on the estimated coolant temperature. In a first example of the method, wherein the thermostat is at a first position to flow the coolant through the radiator, and at a second position to bypass the coolant from the radiator. A second example of the method optionally includes the first example and further includes, wherein the cooling system health includes radiator failure, radiator useful life, and thermostat degradation. A third example of the method optionally includes one or more of the first and second examples, and further comprising indicating the radiator health based on an oscillation of the estimated coolant temperature. A fourth example of the method optionally includes one or more of the first through third examples, and further comprising indicating radiator health based on the amplitude of the oscillation. A fifth example of the method optionally includes one or more of the first through fourth examples, and further includes, indicating radiator health if the number of oscillation in the estimated coolant temperature is greater than a threshold. A sixth example of the method optionally includes one or more of the first through fifth examples, and further includes, wherein the estimated coolant temperature is the coolant temperature at a radiator outlet. A seventh example of the method optionally includes one or more of the first through sixth examples, and further includes, wherein the estimated coolant temperature is coolant temperature in a radiator end tank. A eighth example of the method optionally includes one or more of the first through seventh examples, and further includes, measuring the coolant temperature at a position between an end of a radiator core and a junction of a radiator lower hose and a heater core output line via a sensor. A ninth example of the method optionally includes one or more of the first through eighth examples, and further includes, indicating thermostat degradation by comparing the measured coolant temperature with the estimated coolant temperature.

As another embodiment, a method for a cooling system, comprising: stopping coolant flow from a thermostat to a radiator; determining a coolant flow rate from a heater core to a radiator end tank; estimating a coolant temperature at a position between an end of a radiator core and a junction of a radiator lower hose and a heater core output line; and indicating degradation of the cooling system based on the estimated coolant temperature. In a first example of the method, wherein coolant flow from the thermostat to the downstream radiator is zero when the coolant flow is stopped. A second example of the method optionally includes the first example and further includes estimating an engine temperature based on the estimated coolant temperature, and operating the engine responsive to the estimated engine temperature. A third example of the method optionally includes one or more of the first and second examples, and further includes estimating a radiator temperature based on the estimated coolant temperature, and operating a radiator fan responsive to the estimated radiator temperature. A fourth example of the method optionally includes one or more of the first through third examples, and further includes, wherein the engine temperature is estimated based on a measured coolant temperature at the position between the end of a radiator core and the junction of the radiator lower hose and the heater core output line via a thermal state estimator.

As yet another embodiment, a vehicle system, comprising: a pump upstream of an engine for pumping coolant to the engine; a radiator includes a radiator core and an end tank; a lower hose directly coupled to the end tank; a heater core; a thermostat downstream of the engine to control coolant flow to a radiator; and a controller configured with computer readable instructions stored on non-transitory memory for: estimating coolant temperature at a position between an end of a radiator core and a junction of a radiator lower hose and a heater core output line; predicting radiator failure based on the estimated coolant temperature; and operating the engine responsive to the predicated radiator failure. In a first example of the system, the end tank of the radiator is in direct fluid communication with both an input of the pump and an outlet of the heater core. A second example of the system optionally includes the first example and further includes, wherein the controller is further configured for predicating radiator failure based on a coolant flow rate from the heater core to the radiator end tank when the radiator is bypassed. A third example of the system optionally includes one or more of the first and second examples, and further includes, wherein the controller is further configured for determining thermostat degradation. A fourth example of the system optionally includes one or more of the first through third examples, and further includes, wherein the controller is further configured for adjusting a radiator fan responsive to the predicated radiator failure.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for a cooling system, comprising:

adjusting coolant flow with a thermostat;

based on thermostat position, estimating a coolant temperature at a position between an end of a radiator core and a junction of a radiator lower hose and a heater core output line; and indicating cooling system health based on the estimated coolant temperature, wherein the cooling system health includes radiator failure, radiator useful life, and thermostat degradation.

2. The method of claim 1, wherein the thermostat is at a first position to flow coolant through a radiator, and at a second position to bypass the coolant from the radiator.

3. The method of claim 1, further comprising indicating the cooling system health based on an oscillation of the estimated coolant temperature.

4. The method of claim 3, further comprising indicating radiator failure based on an amplitude of the oscillation.

5. The method of claim 4, further comprising indicating cooling system health if a number of oscillations in the estimated coolant temperature is greater than a threshold.

6. The method of claim 1, wherein the estimated coolant temperature is the coolant temperature at a radiator outlet.

7. The method of claim 1, wherein the estimated coolant temperature is coolant temperature in a radiator end tank.

8. The method of claim 1, further comprising measuring the coolant temperature at the position between the end of the radiator core and the junction of the radiator lower hose and the heater core output line via a sensor.

9. The method of claim 8, further comprising indicating thermostat degradation by comparing a measured coolant temperature with the estimated coolant temperature.

10. A method for a cooling system, comprising:

stopping coolant flow from a thermostat to a radiator;

determining a coolant flow rate from a heater core to an end tank of the radiator;

estimating a coolant temperature at a position between an end of a radiator core and a junction of a radiator lower hose and a heater core output line; and indicating degradation of the cooling system based on the estimated coolant temperature.

11. The method of claim 10, wherein the coolant flow rate from the thermostat to the radiator downstream of the thermostat is zero when the coolant flow is stopped.

12. The method of claim 10, further comprising estimating an engine temperature based on the estimated coolant temperature, and operating an engine responsive to the estimated engine temperature.

13. The method of claim 10, further comprising estimating a radiator temperature based on the estimated coolant temperature, and operating a radiator fan responsive to the estimated radiator temperature.

14. The method of claim 10, wherein the engine temperature is estimated based on a measured coolant temperature at the position between the end of the radiator core and the junction of the radiator lower hose and the heater core output line via a thermal state estimator.

* * * * *